United States Patent [19]

Gonzales et al.

[11] Patent Number: 4,822,039

[45] Date of Patent: Apr. 18, 1989

[54] PIVOTING LEG AND ARM EXERCISE DEVICE

[76] Inventors: Charles B. Gonzales; Benjamin C. Gonzales, both of 101 E. Wilson, Gallup, N. Mex. 87301

[21] Appl. No.: 152,675

[22] Filed: Feb. 5, 1988

[51] Int. Cl.[4] ..... A63B 23/04

[52] U.S. Cl. ..... 272/146; 272/136

[58] Field of Search ..... 272/96, 97, 70, 93, 272/144, 145, 146, 130, 135, 136, 138, 141, 142

[56] References Cited

U.S. PATENT DOCUMENTS

| | | | |
|---|---|---|---|
| 393,265 | 11/1888 | Rice | 272/138 |
| 735,319 | 8/1905 | Urwick | 272/146 X |
| 3,295,847 | 1/1967 | Matt, Sr. | 272/96 |
| 3,416,792 | 12/1968 | Morgan et al. | 272/146 |
| 3,441,271 | 4/1969 | Palacios | 272/146 X |
| 3,511,500 | 5/1970 | Dunn | 272/70 X |
| 3,575,412 | 4/1971 | Arsenian | 272/97 |
| 3,741,540 | 6/1973 | Shimizu | 272/141 X |
| 4,089,520 | 5/1978 | Ozbey et al. | 272/136 |
| 4,111,416 | 9/1978 | Jinotti | 272/96 |
| 4,132,405 | 1/1979 | Asher | 272/146 |
| 4,304,402 | 12/1981 | Ripp | 272/137 |
| 4,351,527 | 9/1982 | Crisp, Jr. | 272/137 |
| 4,376,532 | 3/1983 | Hunstad | 272/146 X |
| 4,583,731 | 4/1986 | Crivello et al. | 272/144 |
| 4,619,454 | 10/1986 | Walton | 272/141 |

*Primary Examiner*—Richard J. Apley
*Assistant Examiner*—Howard Flaxman
*Attorney, Agent, or Firm*—Jerry T. Kearns

[57] ABSTRACT

Base and pivot blocks, each having a generally triangular transverse cross section, are pivotally mounted at their central apexes by an elongated pivot axle. The pivot block has a flat upper surface having a plurality of outwardly extending mounting rails spaced along opposite side edges. A pair of mounting blocks having cooperating recesses are adjustably mounted on the side edges of the pivot block. A foot support is adjustably secured on each of the mounting blocks. A plurality of coil springs extend between the base and pivot blocks, each of the springs having opposite end portions received in cylindrical recesses in the pivot and base blocks. A hand grip is attached by at least elongated coil spring to an outer side edge of each of the adjustable mounting blocks. In use, an individual stands on the pivot block, with their feet on the foot supports. The user rocks from side to side against the resistance of the springs extending between the pivot and base blocks. By varying the number of springs between the base and pivot blocks, a user may select the desired resistance. As an individual rocks from side to side on the pivot block, the hand grips are extended against the resistance of the elongated coil springs, providing arm exercise for the individual.

1 Claim, 3 Drawing Sheets

PIVOTING LEG AND ARM EXERCISE DEVICE

BACKGROUND OF THE INVENTION

1. Field of the Invention

The present invention relates to exercise devices, and more particularly pertains to a spring resistance type exercise device. In order for an individual to maintain proper muscle tone, a large number of muscle groups must be regularly exercised. These muscle groups include inner thigh muscles, calf muscles, ankles, stomach, arm, shoulder and back muscles. In order to exercise all these muscle groups, individuals must currently perform a large number of complex and time consuming exercises. These exercises entail going to a fully equipped gym, or performing a variety of complex and difficult exercises on expensive home exercise equipment. In order to overcome these problems, the present invention provides a simple, inexpensive spring resistance exercise device which may be utilized to exercise a large number of muscle groups while performing a single simple exercise. The exercise device of the present invention also provides aerobic conditioning.

2. Description of the Prior Art

Various types of exercise devices are known in the Prior art. A typical example of such an exercise device is to be found in U.S. Pat. No. 4,089,520, Which issued to A. Ozbey et al on May 16, 1978. This patent discloses a spring resistance exercise device having a platform with arm exercise members extending laterally from opposite sides thereof. These arm exercise members are mounted to pivot vertically and horizontally and coil springs are provided to oppose this pivotal movement. Also, a leg and abdominal exercise member is mounted on the platform for universal pivotal movement relative to the platform. This leg and abdominal exercise member includes a plurality of coil springs to provided resistance. U.S. Pat. No. 4,304,402, which issued to H. Ripp on Dec. 8, 1981, discloses an exercise device which has a base provided with a foot receiving stirrup. The base is connected by a plurality of coil springs to a handle bar unit. An individual places one or both feet in the base stirrup, while manipulating the handle bar against the bias of the coil springs. The number of coil tension springs may be varied to alter the degree of resistance. U.S. Pat. No. 4,351,527, which issued to M. Crisp, Jr. on Sept. 28, 1982, discloses a spring resistance exercise device having a generally rectangular base on which an upstanding compressible spring resistance column is transversely attached. A rod slidably mounted in the column has an upper end provided with a transversely extending handle bar. A second hand grip is provided adjacent the platform base. The exercise device may be utilized to perform a variety of exercises against the resistance of the spring column. U.S. Pat. No. 4,583,731, which issued to J. Crivello et al on Apr. 22, 1986, discloses a spinal exercising table which has an elongated bench pivotally secured to a central apex of a tubular, generally triangular-shaped frame. The bench is pivotable through a range of motion against the resistance of the telescopic spring column. U.S. Pat. No. 4,619,454, which issued to R. Walton on Oct. 28, 1986, discloses a leg conditioner for leg split type exercises. An elongated rail designed for support on a floor has a pair of handles disposed at a central portion thereof. A pair of foot stop elements are slidably mounted for parallel movement against a spring resistance at opposite ends of the rail. In use, an individual places one foot against each of the foot stop elements and performs a leg split type exercise against the spring resistance.

While the above mentioned devices are suited for their intended usage, none of these devices provide a spring resistance exercise device which will simultaneously exercise a large number of muscle groups while performing a single simple exercise. Additionally, none of the aforesaid exercise devices provides a pivot block mounted for pivotal movement against a spring force on a base block and having provisions for exercising both arm and leg muscles. Inasmuch as the art is relatively crowded with respect to these various types of exercise devices, it can be appreciated that there is a continuing need for and interest in improvements to such exercise devices, and in this respect, the present invention addresses this need and interest.

SUMMARY OF THE INVENTION

In view of the foregoing disadvantages inherent in the known types of exercise devices now present in the prior art, the present invention provides an improved exercise device. As such, the general purpose of the present invention, which will be described subsequently in greater detail, is to provide a new and improved exercise device which has all the advantages of the prior art exercise devices and none of the disadvantages.

To attain this, a representative embodiment of the concepts of the present invention is illustrated in the drawings and makes use of base and pivot blocks, each having a generally triangular transverse cross section, which are pivotally mounted at their central apexes by an elongated pivot axle. The pivot block has a flat upper surface having a plurality of outwardly extending mounting rails spaced along opposite side edges. A pair of mounting blocks having cooperating recesses are adjustably mounted on the side edges of the pivot block. A foot support is adjustably secured on each of the mounting blocks. A plurality of coil springs extend between the base and pivot blocks, each of the springs having opposite end portions received in cylindrical recesses in the pivot and base blocks. A hand grip is attached by at least one elongated coil spring to an outer side edge of each of the adjustable mounting blocks. In use, an individual stands on the pivot block, with their feet on the foot supports. The user rocks from side to side against the resistance of the springs extending between the pivot and base blocks. By varying the number of springs between the base and pivot blocks, a user may select the desired resistance. As an individual rocks from side to side on the pivot block, the hand grips are extended against the resistance of the elongated coil springs, providing arm exercise for the individual.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise device which has all the advantages of the prior art exercise devices and none of the disadvantages.

It is another object of the present invention to provide a new and improved exercise device which may be easily and efficiently manufactured and marketed.

It is a further object of the present invention to provide a new and improved exercise device which is of a durable and reliable construction.

An even further object of the present invention is to provide a new and improved exercise device which is susceptible of a low cost of manufacture with regard to both materials and labor, and which accordingly is then susceptible of low prices of sale to the consuming public, thereby making such exercise devices economically available to the buying public.

Still yet another object of the present invention is to provide a new and improved exercise device which provides in the apparatuses and methods of the prior art some of the advantages thereof, while simultaneously overcoming some of the disadvantages normally associated therewith.

Still another object of the present invention is to provide a new and improved exercise device having provisions for exercising a large number of muscle groups while performing a single simple exercise.

Yet another object of the present invention is to provide a new and improved exercise device which utilizes a pivot block mounted for pivotal movement against a spring resistance on a base block and having adjustable foot supports and laterally extendable spring resistance arm exercising hand grips.

Even still another object of the present invention is to provide a new and improved exercise device which allows resistance for upper and lower body exercises to be independently varied.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
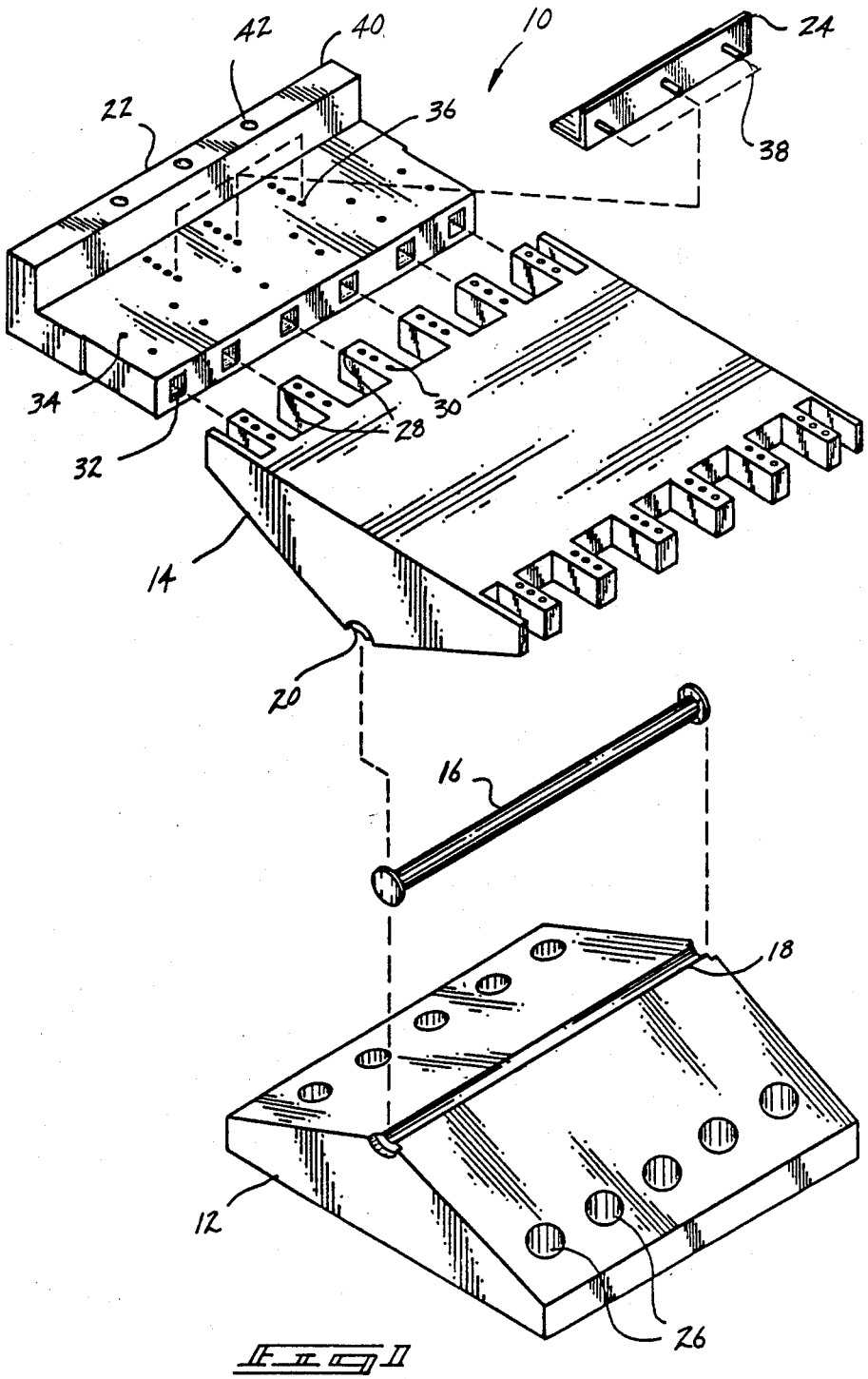
FIG. 1 is a exploded perspective view of a portion of the exercise device of the present invention.

With reference now to the drawings, and in particular to FIG. 1 thereof, a new and improved exercise device embodying the principles and concepts of the present invention and generally designated by the reference numeral 10 will be described.

More specifically, it will be noted that the first embodiment 10 of the invention includes a base block 12 having a generally triangular transverse cross sectional shape. The base block 12 is provided with an elongated semi-cylindrical recess 18 which extends along the apex of the block 12. A plurality of cylindrical recesses 26 are spaced along opposite side edges of the base block 12. A pivot block 14, having a generally triangular transverse cross sectional shape, has a semicylindrical elongated pivot bearing recess 20 which extends along the apex of the pivot block 14. The pivot block 14 is pivotally mounted on the base block 12 by a pivot axle 16 which is received between the blocks 12 and 14 in the recesses 18 and 20. A plurality of outwardly extending mounting rails 28 are spaced along opposite side edges of the pivot block 14. Each of the mounting rails 28 is provided with a plurality of spaced pin receiving recesses 30. An adjustable mounting block 22, having a generally L-shaped transverse cross sectional shape, is provided with a plurality of spaced recesses 32 adapted for cooperation with the mounting rails 28. One of the mounting blocks 22 is provided on each side of the pivot block 14. By inserting the mounting rails 28 within the recesses 32 and inserting retaining pins through the apertures 34 in the mounting block 22, the mounting block 22 may be adjustably secured to the pivot block 14. A foot support 24 is provided with a plurality of pegs 38 adapted for cooperation with a plurality of spaced recesses 36 in the mounting block 22. As may now be understood, the foot support 24 may be adjustably secured on the mounting block 22. While the components on only one side of the pivot block 14 have been illustrated, it is to be understood that similar components are provided on both sides of the pivot mounting block 14, thus a further description of these symmetrically arranged components is not considered necessary.

Figure 2:
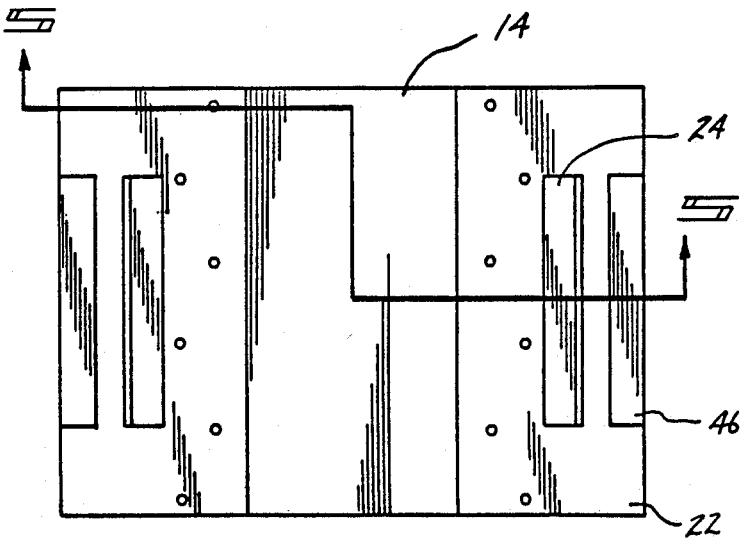
FIG. 2 is a top view of the exercise device of the present invention.

In FIG. 2, a top view is provided, looking downwardly, upon the flat top surface of the pivot block 14. A hand grip 46 is secured adjacent an outer side edge of each of the adjustable mounting blocks 22.

Figure 3:
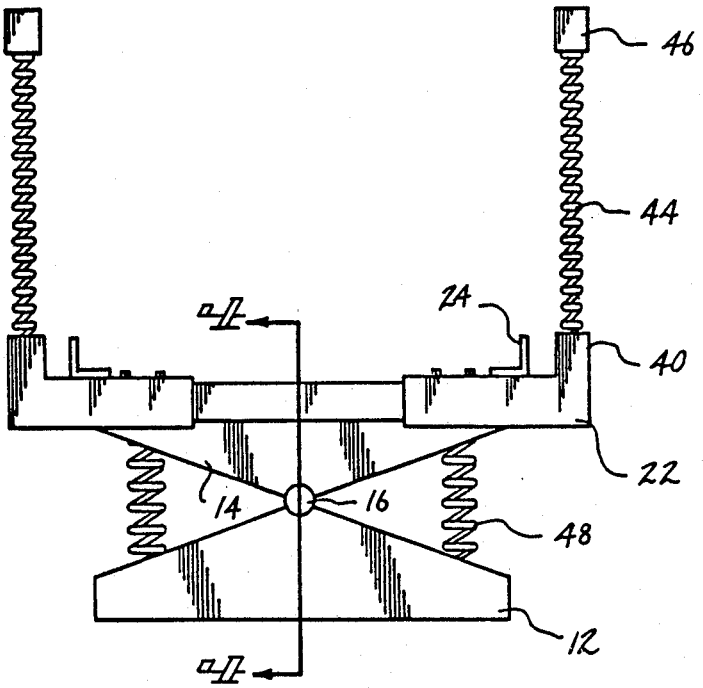
FIG. 3 is an end view of the exercise device of the present invention.

As shown in FIG. 3, the hand grips 46 are secured by at least one coil spring 44 to an upwardly extending leg 40 of the mounting block 22. At least one coil spring 48 extends between the base block 12 and pivot block 14, on each side of the pivot axle 16. In use, an individual places their feet against the foot supports 24 on the adjustable mounting blocks 22 and rocks from side to side against the resistance of the springs 48. While performing these rocking motions, the individual grasps the hand grips 46. When an individual rocks to the left, the hand grips spring 44 on the right side will be automatically extended, thus providing arm and upper body exercise. By varying the number of springs 44 and 48, the upper and lower body resistance may be independently adjusted according to the desires of each individual user. The laterally adjustable mounting blocks 22 and foot supports 24 allow the device to be adjusted for use by a wide variety of individuals of different sizes.

Figure 4:
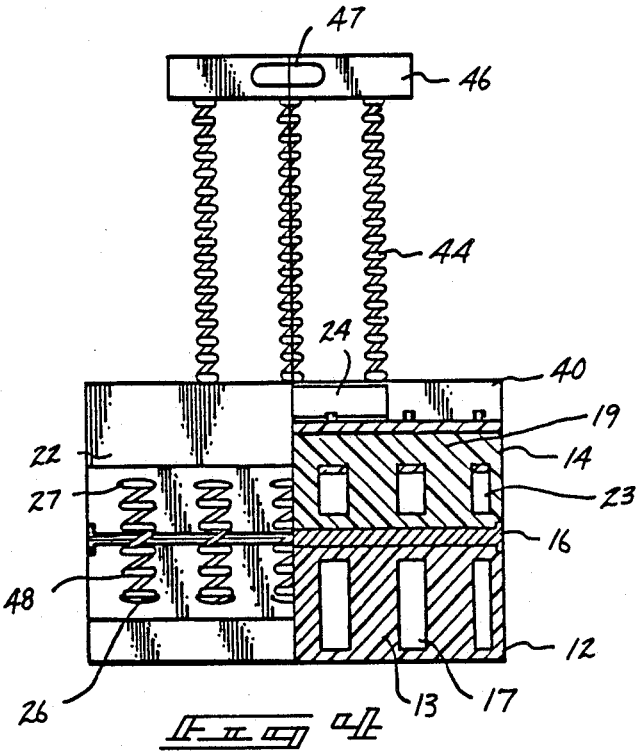
FIG. 4 is a side view, partially in cross section, of the exercise device of the present invention.

In FIG. 4, a side view, partially in cross section, is provided. Each of the hand grips 46 is provided with a centrally positioned elongated slot 47. In use, an individual inserts their hand through the slot 47 to grasp the hand grip 46. While three coil springs 44 are illustrated connecting each of the hand grips 46 to the adjustable mounting block 22, it should be understood that the number of springs 44 may be increased or decreased, to vary the resistance. The base block 12 has a generally hollow interior divided by a central support strut 13. Openings 17 are formed in the support strut 13 for purposes of weight reduction. A similar support strut 19 of the pivot block 14 is provided with a plurality of openings 23, also for purposes of weight reduction. Cylindrical recesses 26 and 27 in the base 12 and pivot 14 blocks receive a plurality of spaced coil springs 48. The springs 48 may be secured in the recesses 26 and 27 by a variety of conventional clamps and threaded fasteners. As previously mentioned, the number of spring 48 may be varied to determine the resistance available for lower body exercises. As may now be understood, when springs on one side of the pivot axle 16 are in compression, the springs 48 on the opposite side of the pivot axle 16 will be in tension. By virtue of this arrangement, a resistance will be provided through a full range of movement.

Figure 5:
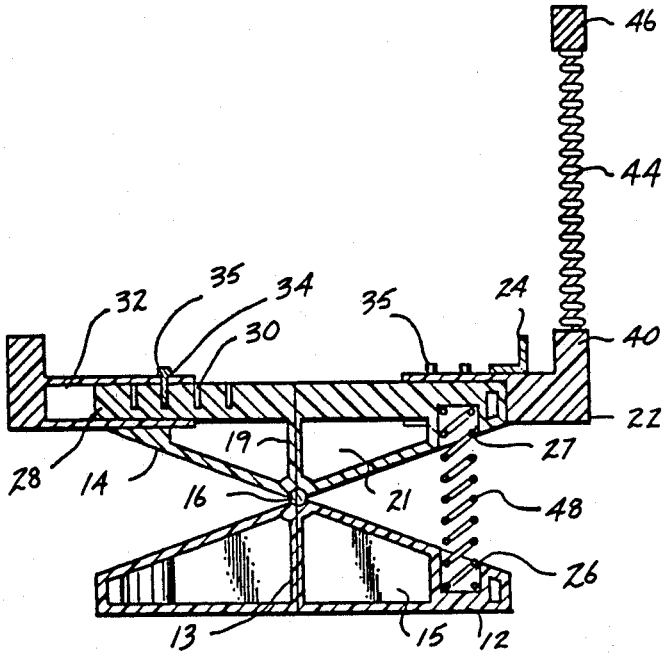
FIG. 5 is a transverse cross sectional view, taken along line 5—5 of FIG. 2, illustrating the exercise device of the present invention.

In FIG. 5, a transverse cross sectional view taken along line 5—5 of FIG. 2, illustrates the internal construction of the base 12 and pivot 14 blocks. The base block 12 has a generally triangular transverse cross sectional shape and a hollow open interior 15 subdivided by a vertical central support strut 13. Pivot block 14 also has a generally triangular transverse cross sectional shape with a hollow interior 21 subdivided by a vertical central support strut 19. The adjustable mounting arrangement of the mounting blocks 22 on the pivot block 14 is clearly illustrated on the left hand side of FIG. 5. A retaining pin 35 which extends through aligned recesses 34 and 30 in the mounting block 22 and pivot block 14 serves to laterally adjustably mount the block 22. The various components of the invention may be formed from a variety of conventional materials such as wood, metal or plastic. The device may be inexpensively constructed and is of a small size so as to be easily transportable and suitable for home use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved exercise device, comprising:

a base block having a generally rectangular flat bottom surface and a generally triangular transverse cross sectional shape;

an elongated semi-cylindrical pivot axle recess formed at a central apex of said base block;

a plurality of lower cylindrical recesses spaced along opposite side edges of said base block;

said lower cylindrical recesses disposed on opposite sides of said pivot axle recess;

a pivot block having a generally rectangular flat top surface and a generally triangular transverse cross sectional shape;

an elongated semi-cylindrical pivot bearing recess formed at a central apex of said pivot block;

a plurality of upper cylindrical recesses spaced along opposite side edges of said pivot block, said upper cylindrical recesses disposed on opposite sides of said pivot bearing recess;

a pivot axle received between said base block and said pivot block, said pivot axle received in said pivot axle and pivot bearing recesses and supporting said pivot block on said base block;

at least one coil spring connecting said base and pivot blocks on each side of said pivot axle, each of said coil springs having opposite ends secured in one of said upper cylindrical recesses and one of said lower cylindrical recesses;

a plurality of outwardly extending mounting rails spaced along opposite side edges of said pivot block, each of said rails provided with a plurality of spaced adjustment apertures;

a pair of generally "L"-shaped adjustable mounting blocks secured on opposite side edges of said pivot block, each of said adjustable mounting blocks having a plurality of spaced rail receiving recesses dimensioned for reception of said mounting rails;

a plurality of retaining pin receiving apertures communicating with each of said rail recesses;

a plurality of retaining pins adjustably securing said mounting rails in said rail recesses;

a pair of foot supports adjustably secured on said adjustable mounting block;

a pair of hand grips; and at least one elongated coil spring securing each of said hand grips to one of said adjustable mounting blocks.

* * * * *